US005211392A

United States Patent [19]

Swanson et al.

[11] Patent Number: 5,211,392

[45] Date of Patent: May 18, 1993

[54] SHEET TRANSPORT APPARATUS FOR USE IN AN ELECTROPHOTOGRAPHIC PRINTING MACHINE

[75] Inventors: Roger M. Swanson, Fairport; Scott C. Durland, Rochester; James R. Cassano, Penfield; David T. Pfeiffer, Fairport, all of N.Y.

[73] Assignee: Xerox Corporation, Stamford, Conn.

[21] Appl. No.: 755,409

[22] Filed: Sep. 5, 1991

[51] Int. Cl.[5] ..... B65H 5/02

[52] U.S. Cl. ..... 271/277; 271/204; 198/476.1

[58] Field of Search ..... 271/277, 275, 204–206; 198/476.1, 803.7

[56] References Cited

U.S. PATENT DOCUMENTS

| | | | |
|---|---|---|---|
| 4,073,489 | 2/1978 | Idstein et al. | 271/277 |
| 4,799,664 | 1/1989 | Burger | 271/277 |
| 4,972,234 | 11/1990 | Tanaka et al. | 271/277 X |
| 4,986,526 | 1/1991 | Dastin | 271/277 X |
| 5,128,726 | 7/1992 | Cassano et al. | 271/277 X |
| 5,151,745 | 9/1992 | Durland et al. | 271/277 X |

*Primary Examiner*—David H. Bollinger
*Attorney, Agent, or Firm*—P. J. Maginot

[57] ABSTRACT

An apparatus is described for releasably gripping a sheet and advancing the sheet through a transfer zone and into registration with information developed on a moving member. The apparatus includes a first gripping member and a second gripping member adapted to be moved relative to the first gripping member. The apparatus further includes a mechanism for applying a force on the second gripping member to urge the second gripping member towards the first gripping member to grip the sheet. Moreover, the apparatus includes a mechanism for advancing the first gripping member and the second gripping member through the transfer zone. The apparatus additionally includes a mechanism for moving the second gripping member relative to the first gripping member to acquire or release the sheet. The apparatus further includes a mechanism for positioning the moving mechanism in a first mode of operation to allow the moving mechanism to move the second gripping member, and, in a second mode of operation to prevent the moving mechanism from moving the second gripping member. The printing machine still further includes a mechanism for isolating the positioning mechanism from the force applied by the force applying mechanism during the first mode of operation.

10 Claims, 8 Drawing Sheets

SHEET TRANSPORT APPARATUS FOR USE IN AN ELECTROPHOTOGRAPHIC PRINTING MACHINE

This invention relates generally to an electrophotographic printing machine and, more particularly, concerns a sheet transport apparatus for use in an electrophotographic printing machine.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed in an imaging zone to a light source such as a raster output scanner. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material into contact therewith. Generally, the developer material comprises toner particles adhering triboelectrically to carrier granules. The toner particles are attracted to the latent image from the carrier granules to form a toner image on the photoconductive member which is subsequently transferred to a copy sheet. The copy sheet is then heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal the printing machine where a plurality of toner images are transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper which is spring biased in the closed position grips one edge of the copy sheet and moves the sheet in a recirculating path so that accurate multi-pass color registration is achieved. In this way, magenta, cyan, yellow, and black toner images are transferred to the copy sheet in registration with one another.

Some systems which have been designed for transporting a copy sheet into registration with a toner image developed on a moving member utilize a solenoid or other force applying mechanism in order to position a cam. The cam, when properly positioned, cooperates with a cam follower of a sheet gripper to overcome the spring bias thereof thus opening the sheet gripper at predetermined locations in its path of movement in order to acquire or release control of a sheet. During travel of the sheet gripper in the open position, a significant percentage of the force applied by the spring to bias the sheet gripper in the closed position is directed to the force output shaft of the solenoid in the direction opposite to which it is applying force to the cam follower. As a result, in the above systems, a solenoid was required which possessed the ability to apply sufficient force to position the cam and further to overcome the counterforce applied by the spring of the sheet gripper. Solenoids possessing such ability tend to be relatively financially expensive and physically large.

The following disclosure may be relevant to various aspects of the present invention:

U.S. Pat. No. 4,073,489

Patentee: Idstein et al.

Issued: Feb. 14, 1978

The relevant portion of the foregoing disclosure may be briefly summarized as follows:

U.S. Pat. No. 4,073,489 discloses a device for transporting an original to be copied while resting on a supporting surface, preferably a drum, in a reproduction apparatus. The device includes a control unit serving to turn a gripper shaft which includes a cam means on whose top edge an actuating roller rides and moves a control lever up and down so that the gripper shaft is turned for opening or closing a set of gripper fingers.

In accordance with one aspect of the present invention, there is provided an apparatus for releasably gripping a sheet and advancing the sheet through a transfer zone and into registration with information developed on a moving member. The apparatus includes a first gripping member and a second gripping member adapted to be moved relative to the first gripping member. The apparatus further includes a mechanism for applying a force on the second gripping member to urge the second gripping member towards the first gripping member through the transfer Moreover, the apparatus includes a mechanism for advancing the first gripping member and the second gripping member through the transfer zone. The apparatus additionally includes a mechanism for moving the second gripping member relative to the first gripping member to acquire or release the sheet. The apparatus further includes a mechanism for positioning the moving means in a first mode of operation to allow the moving means to move the second gripping member, and, in a second mode of operation to prevent the moving means from moving the second gripping member. The printing machine still further includes a mechanism for isolating the positioning means from the force applied by the force applying means during the first mode of operation.

Pursuant to another aspect of the present invention, there is provided a printing machine of the type having a toner image developed on a moving member with a sheet being releasably gripped and advanced through a transfer zone and into registration with the toner image. The printing machine includes a first gripping member and a second gripping member adapted to be moved relative to the first gripping member. The printing machine further includes a mechanism for applying a force on the second gripping member to urge the second gripping member towards the first gripping member to grip the sheet. Moreover, the printing machine includes a mechanism for advancing the first gripping member and the second gripping member through the transfer zone. The printing machine additionally includes a mechanism for moving the second gripping member relative to the first gripping member to acquire or release the sheet. The printing machine further includes a mechanism for positioning the moving means in a first mode of operation to allow the moving means to move the second gripping member, and, in a second mode of operation to prevent the moving means from moving the second gripping member. The printing machine still further includes a mechanism for isolating the positioning means from the force applied by the force applying means during the first mode of operation.

Other features of the present invention will become apparent as the following description proceeds and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
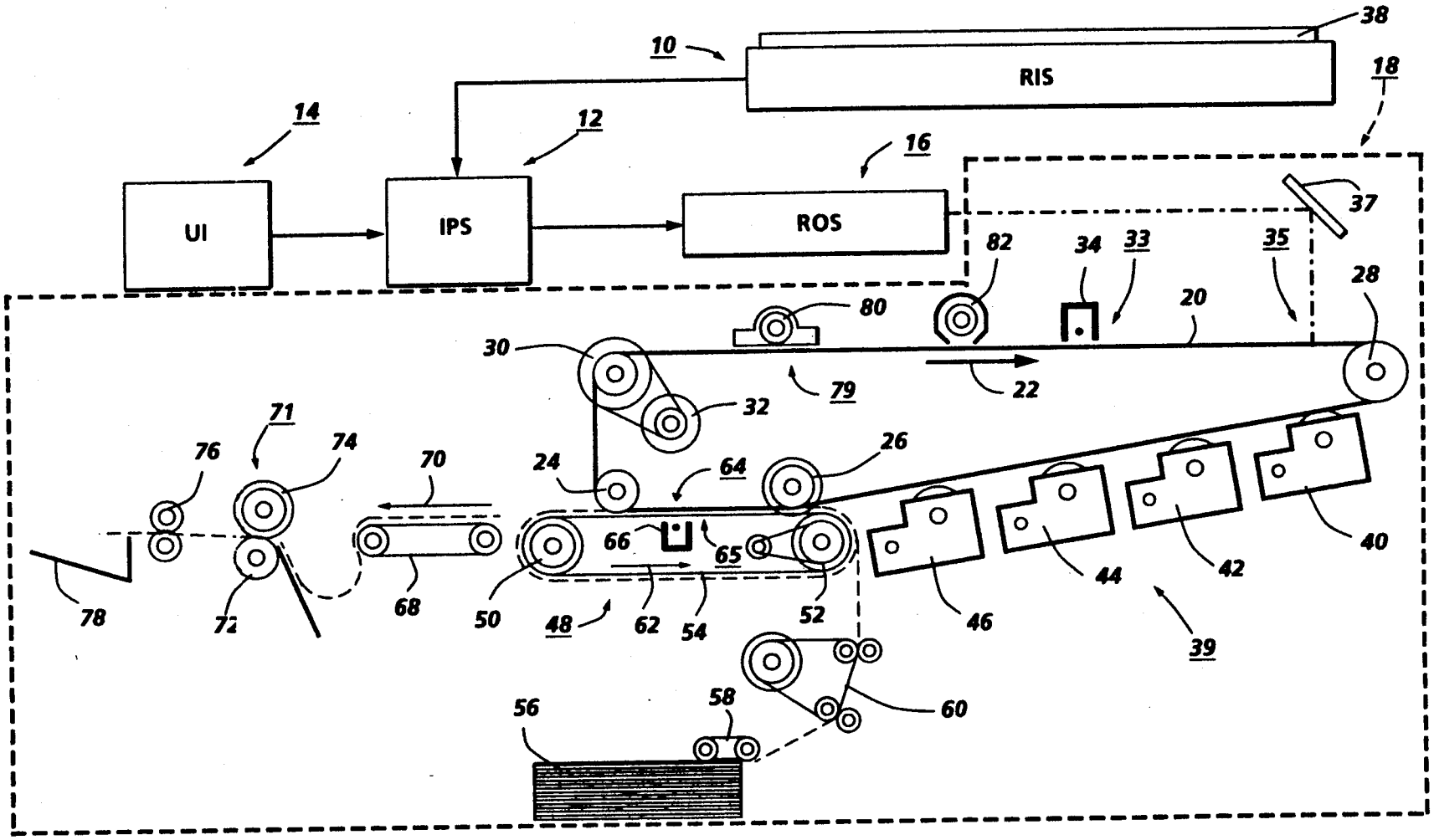
FIG. 1 is a schematic elevational view showing an electrophotographic printing machine incorporating the features of the present invention therein.

For a general understanding of the features of the present invention, reference is made to the drawings. In the drawings, like references have been used throughout to designate identical elements. FIG. 1 is a schematic elevational view showing an electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS) indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. The modulated light beam impinges on the surface of photoconductive belt 20. The beam illuminates the charged portion of photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper 84 (see FIGS. 2–4) extends between belts 54 and moves in unison therewith. A sheet 25 (see also FIGS. 2–4) is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of the sheet gripper. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multi-color copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
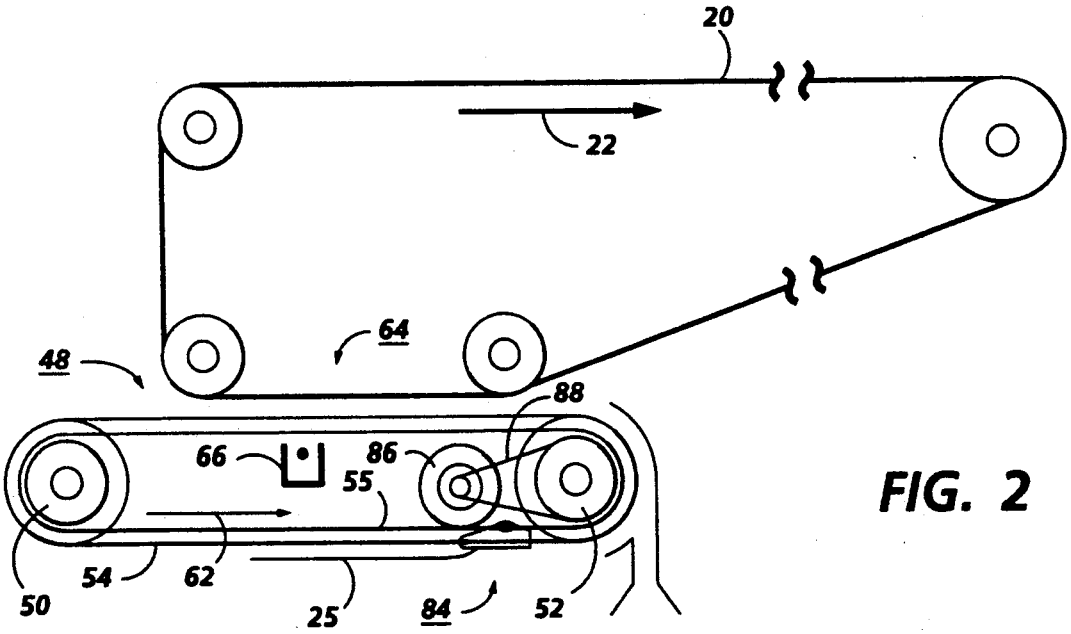
FIG. 2 is a schematic elevational view showing further details of the sheet transport system used in the electrophotographic printing machine of FIG. 1.
Figure 3:
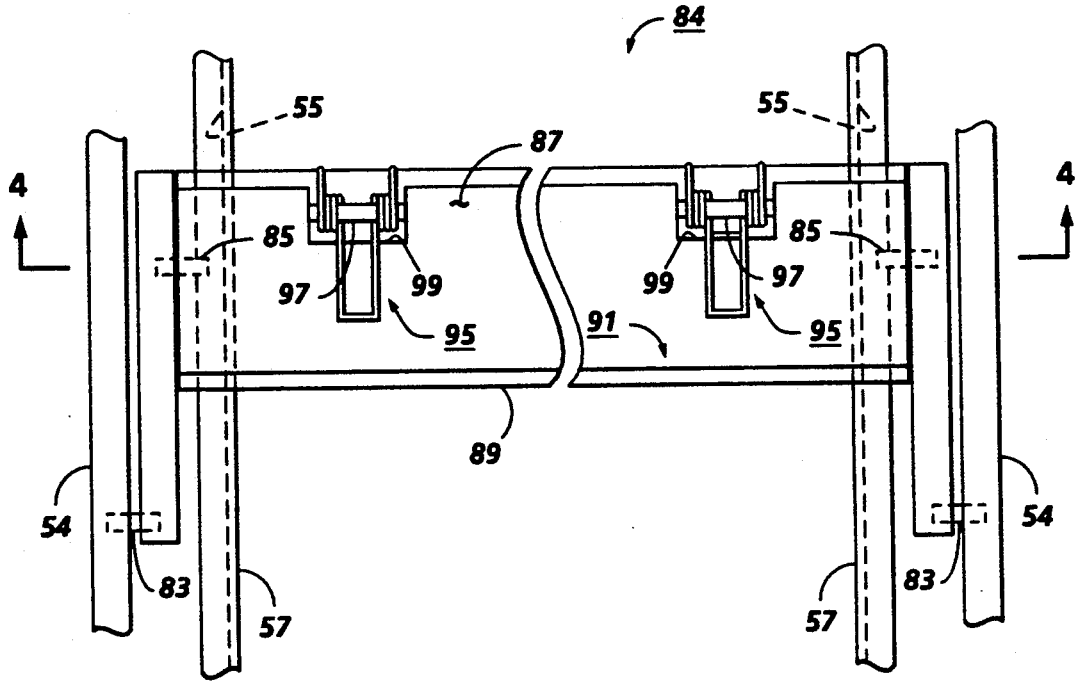
FIG. 3 is a schematic planar view showing the sheet gripper of the sheet transport system used in the electrophotographic printing machine of FIG. 1.
Figure 4:
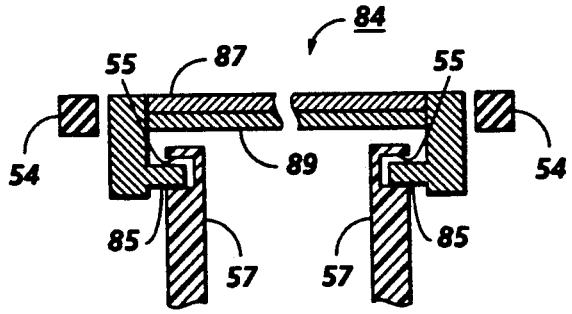
FIG. 4 is a sectional elevational view taken in the direction of arrows 4—4 in FIG. 3 of the opposed side marginal regions of the sheet gripper.

FIG. 2 shows sheet gripper 84 of sheet transport 48 transporting sheet 25 in the direction of arrow 62 in a recirculating path of movement. FIG. 3 shows sheet gripper 84 suspended between two spaced apart timing belts 54. FIG. 4 shows a sectional elevational view of the opposed side marginal regions of sheet gripper 84. Referring to FIGS. 2–4, timing belts 54 are entrained about rollers 50 and 52. Belts 54 define a continuous path of movement of sheet gripper 84. A motor 86 is coupled to roller 52 by a drive belt 88. Sheet gripper 84 includes a pair of guide members 85. A pair of spaced apart and continuous tracks 55 are respectively positioned substantially adjacent belts 54. Tracks 55 are respectively defined by a pair of track supports 57. Each of guide members 85 are slidably positioned within a respective track 55. Sheet gripper 84 further includes an upper sheet gripping portion 87 and a lower sheet gripping portion 89 which are biased toward each other by a plurality of springs, each being generally indicated by the reference numeral 95 as shown in FIG. 3. A plurality of securing pins 97 are respectively positioned within a plurality of apertures 99 of upper gripping portion 87 and secured thereto to hold springs 95 in place so as to bias upper gripping portion 87 toward lower gripping portion 89.

The sheet gripper further includes a pair of cam followers 100 (see FIGS. 5–7) which are attached to the opposed side marginal regions of upper gripping portion 87 and function with a pair of cam surfaces 101 (see also FIGS. 5–7) to displace upper gripping portion 87 relative to lower gripping portion 89 to open and close the sheet gripper at predetermined intervals. In the closed position, gripping portion 87 cooperates with gripping portion 89 to grasp and securely hold the leading edge of sheet 25. The area at which the gripping portions 87 and 89 grasp sheet 25 defines a gripping nip, generally indicated by the reference numeral 91 (see FIG. 3). A silicone rubber coating (not shown) may be positioned upon lower sheet gripping portion 89, near gripping nip 91, in order to increase the frictional grip of sheet 25 between the gripping portions. Belts 54 are respectively connected to the opposed side marginal regions of sheet gripper 84 by a pair of pins 83 as shown in FIG. 3. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected.

Figure 5:
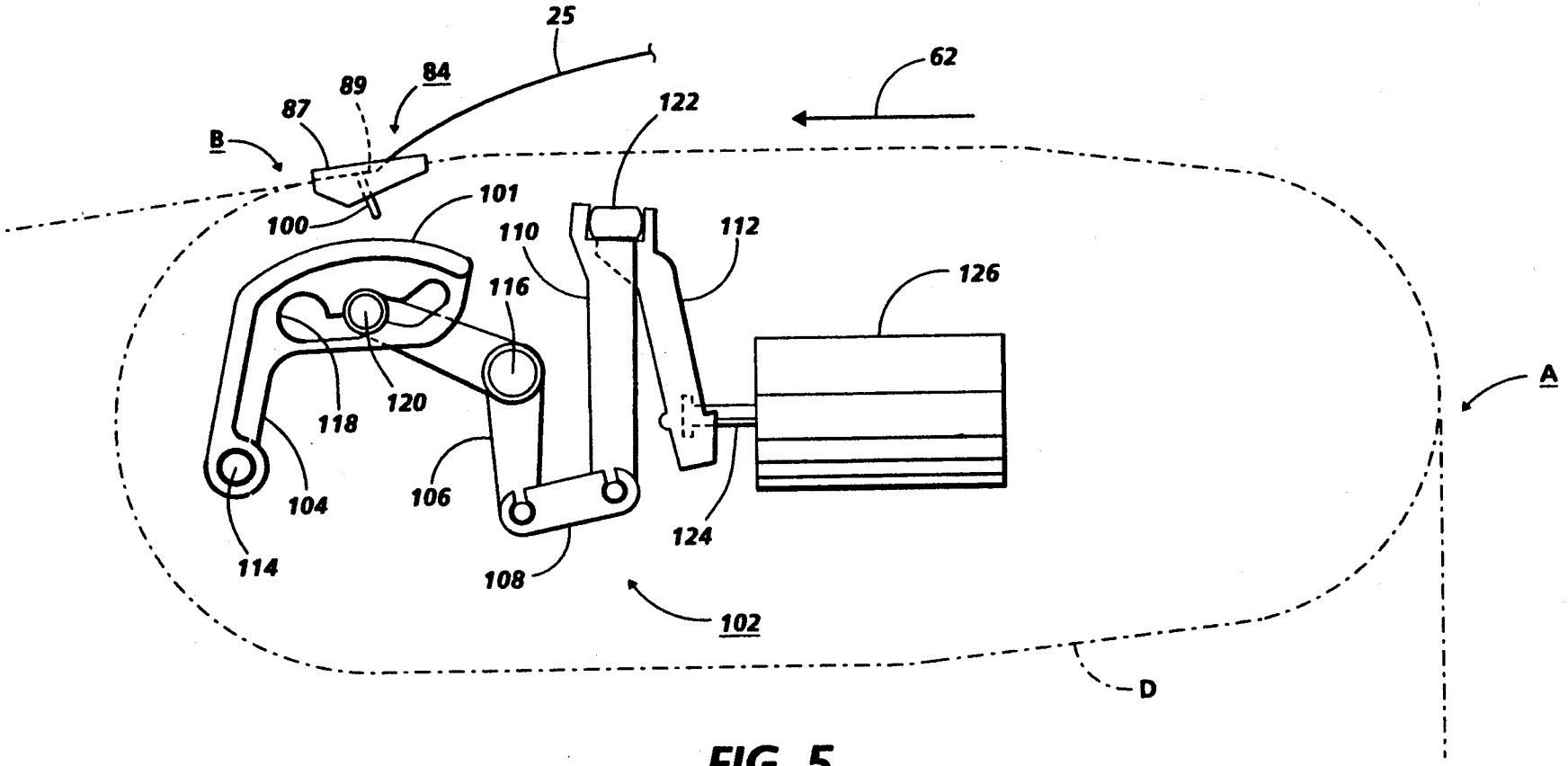
FIG. 5 is a schematic elevational view of one of the cam mechanisms of the sheet transport system used in the electrophotographic printing machine of FIG. 1 wherein the cam mechanism is shown in a first mode of operation and further showing the sheet gripper gripping the sheet.

FIG. 5 shows sheet gripper 84 traveling in the direction of arrow 62 in its path of movement which is indicated by a dashed line D. Sheet 25 is acquired by sheet gripper 84 at a location generally indicated by the reference letter A. The sheet is then transported in a recirculating path of movement for three successive cycles as previously described. Thereafter, the sheet is released by the sheet gripper at a location generally indicated by the reference letter B.

Sheet transport system 48 includes a pair of cam mechanisms, generally indicated by the reference numeral 102. The cam mechanisms are spaced apart from each other and positioned near a respective track 55 (tracks 55 are not shown in FIGS. 5–7). Since cam mechanisms 102 are substantially similar in structure and moreover function substantially the same, only one of the cam mechanisms will be described in detail.

Referring to FIG. 5, cam mechanism 102 includes a cam arm 104, a first cam link 106, a second cam link 108, a third cam link 110 and a fourth cam link 112. Cam arm 104 is pivotable about a first stationary shaft 114 while first cam link 106 is pivotable about a second stationary shaft 116. A cam surface 101 is defined on cam arm 104 and further a cam profile 118 is defined in cam arm 104. First cam link 106 includes a nodule 120 which is slidably positioned within cam profile 118. Second cam link 108 is pivotably secured at one of its ends to first cam link 106 and at its other end to third cam link 110. Third cam link 110 is further secured to a rotatable shaft 122. Also secured to rotatable shaft 122 is fourth cam link 112. Fourth cam link 112 is further secured to a force output shaft 124 of a solenoid 126. When solenoid 126 is in one mode of operation, shaft 124 of the solenoid is positioned so as to maintain cam arm 104, via cam links 106, 108, 110 and 112, out of contact with cam follower 100 of sheet gripper 84. Consequently, upper gripping portion 87 is prevented from being displaced relative to lower sheet gripping portion 89 against the bias of springs 95 as sheet gripper 84 passes over cam arm 104.

Figure 6:
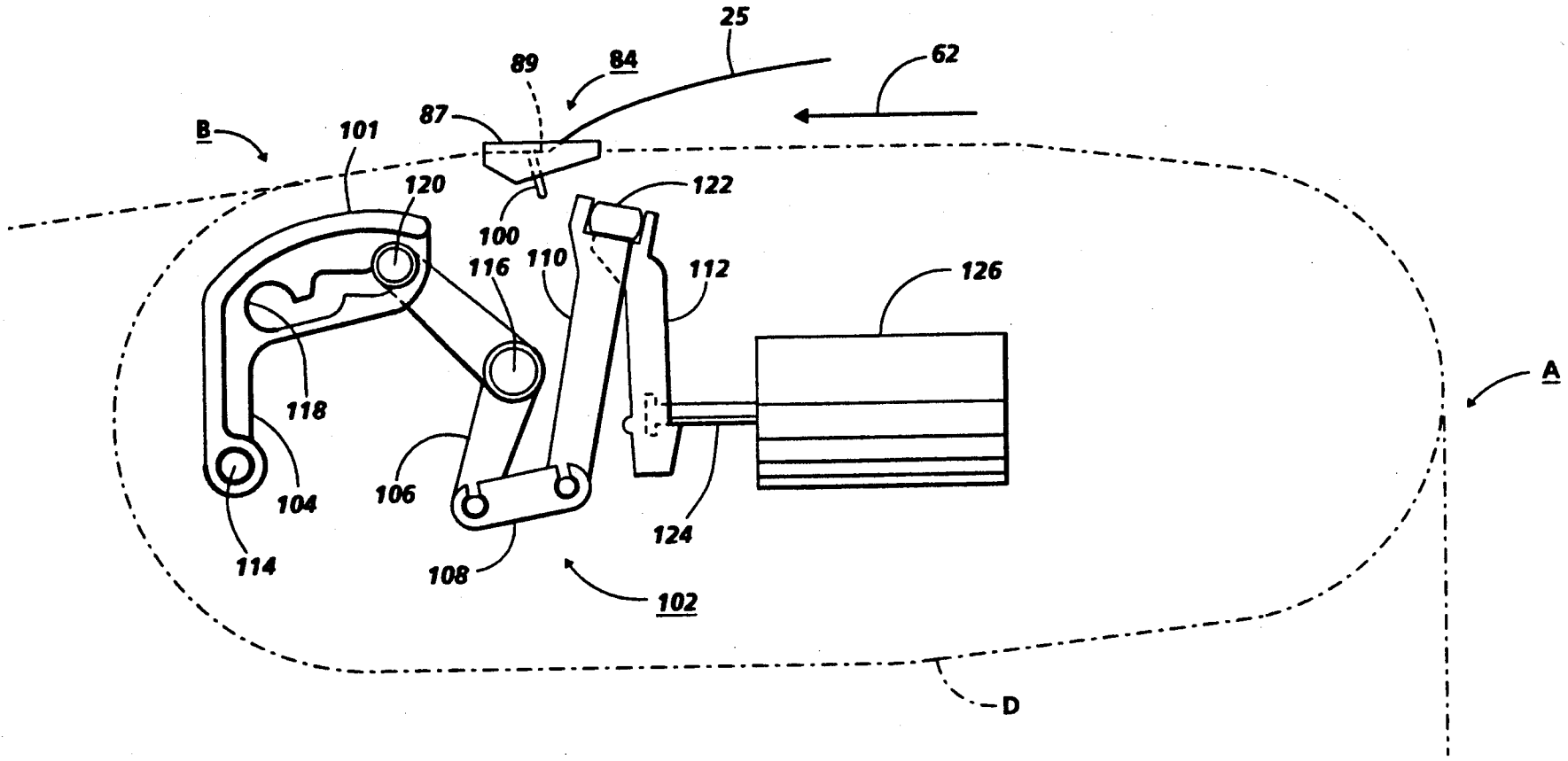
FIG. 6 is a schematic elevational view of the cam mechanism of FIG. 5 wherein the cam mechanism is shown in the second mode of operation and further showing the sheet gripper gripping the sheet.
Figure 7:
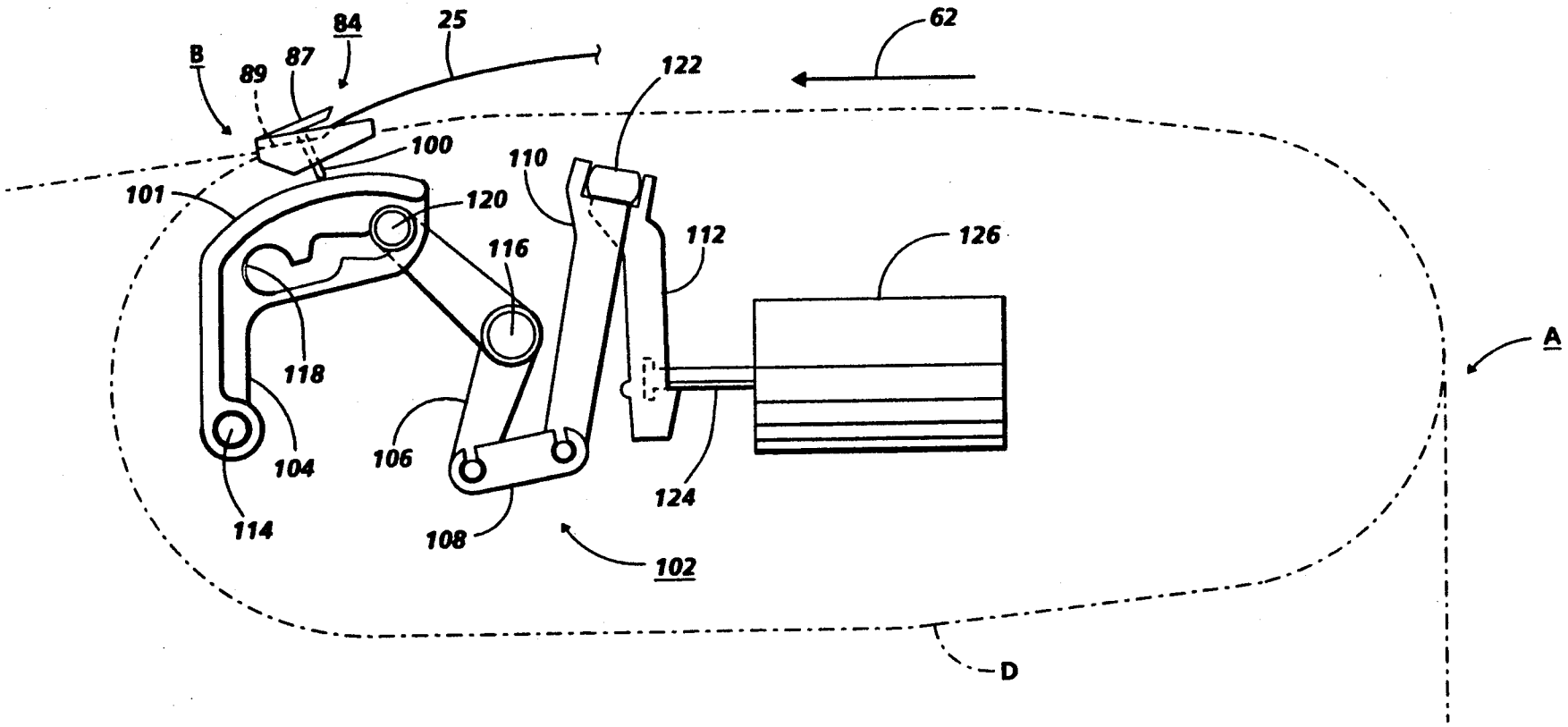
FIG. 7 is a view similar to FIG. 6 but showing the sheet gripper opened to release the sheet.

After the sheet gripper has passed location A in its third successive cycle and prior to arriving at location B, solenoid 126 is actuated to assume another mode of operation. In this mode of operation, shaft 124 is forced to assume another position as shown in FIG. 6. As shaft 124 is forced from its position shown in FIG. 5 to its position shown in FIG. 6, cam arm 104 is forced from its position shown in FIG. 5 to its position shown in FIG. 6. When solenoid 126 is in this mode of operation, shaft 124 of the solenoid is positioned so as to locate cam arm 104, via cam links 106, 108, 110 and 112, to be in the path of cam follower 100 of sheet gripper 84 thereby allowing upper gripping portion 87 to be displaced relative to lower sheet gripping portion 89 against the bias of springs 95 as sheet gripper 84 passes over cam arm 104 as shown in FIG. 7.

Cam mechanism 102 functions to direct substantially all of the force applied by springs 95 to first stationary shaft 114 and second stationary shaft 116 via cam arm 104 and first cam link 106, respectively, when cam follower 100 is in contact with cam surface 101. Consequently, shaft 124 of solenoid 126 is isolated from substantially all of the force applied by springs 95 when cam follower 100 is in contact with cam surface 101.

Figure 8:
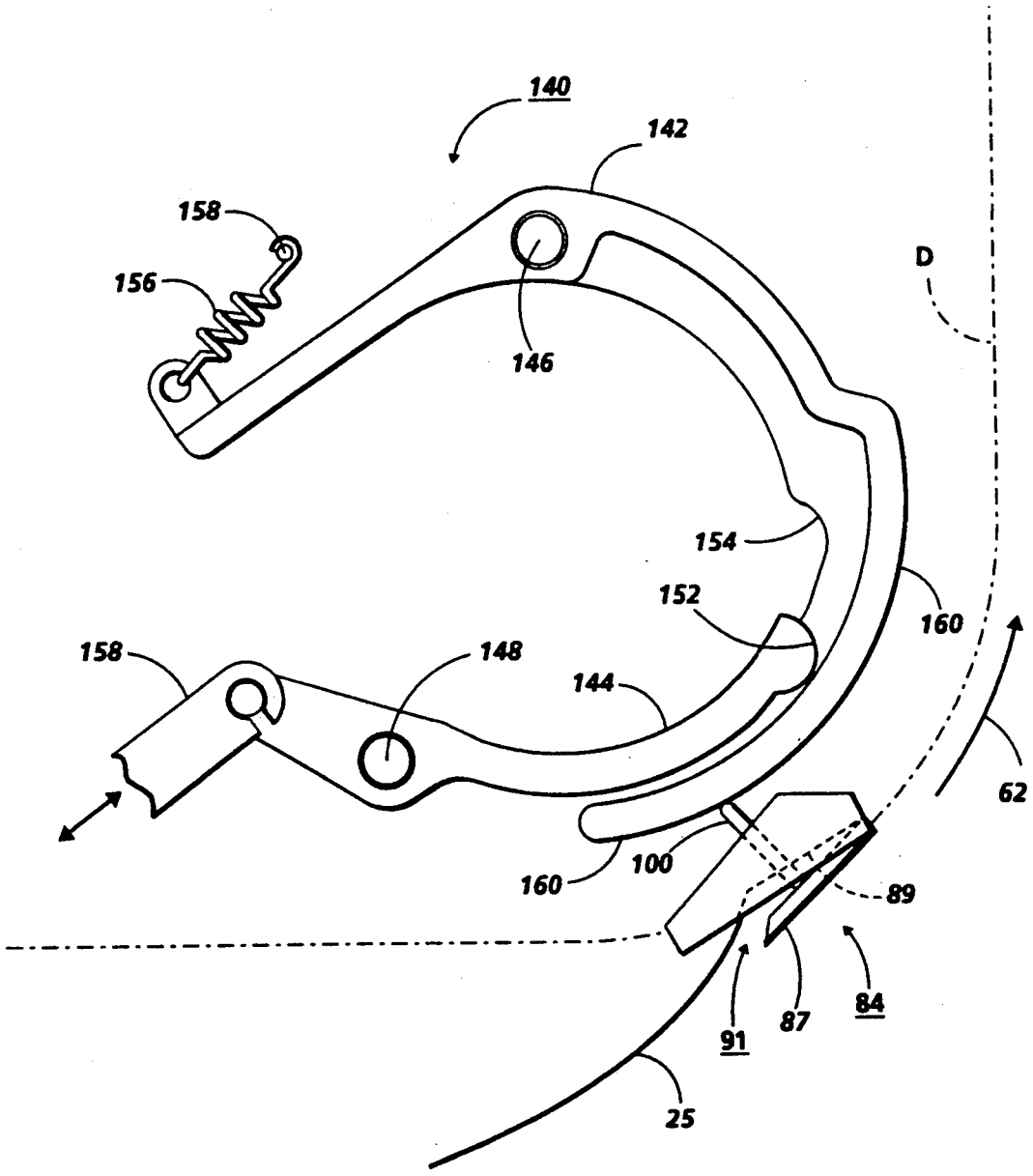
FIG. 8 is a schematic elevational view of an alternative embodiment of a cam mechanism useful in carrying out the present invention wherein the cam mechanism is in one mode of operation.

In another embodiment of the present invention, FIG. 8 shows a cam mechanism, generally indicated by the reference numeral 140. Cam mechanism 140 may be positioned adjacent one of tracks 55 near location A in order to open sheet gripper 84 thereby allowing the sheet gripper to acquire control of sheet 25. A second cam mechanism which is similar to cam mechanism 140 may be positioned adjacent the other track 55 near location A in order to assist cam mechanism 140 in opening sheet gripper 84. FIG. 8 further shows sheet gripper 84 traveling in the direction of arrow 62 in its path of movement a part of which is indicated by a dashed line D. Cam mechanism 140 is positioned adjacent the path of sheet gripper 84. Cam mechanism 140 includes a first cam member 142 and a second cam member 144. Defined in first cam member 142 is a first notch 152 and a second notch 154. A cam surface 160 is also defined on first cam member 142. First cam member 142 is pivotable about a first stationary shaft 146 and second cam member 144 is pivotable about a second stationary shaft 148. A spring 156 is interposed between a third stationary shaft 158 and one end of first cam member 142. As a result, first cam member 142 is spring biased into contact with second cam member 144 as shown in FIG. 8. Second cam member 144 is pivotably attached to a cam link 158. Cam link 158 is attached, via other linkages (not shown), to a force applying shaft of a solenoid (not shown). When the solenoid is in one mode of operation, the shaft of the solenoid is positioned so as to locate first cam member 142, via second cam member 144, cam link 158 and other linkages (not shown), to be in the path of cam follower 100 of sheet gripper 84 thereby allowing upper gripping portion 87 to be displaced relative to lower sheet gripping portion 89 against the bias of springs 95 as sheet gripper 84 passes over first cam member 142 as shown in FIG. 8.

Cam mechanism 140 functions to direct substantially all of the force applied by springs 95 to first stationary shaft 146 and second stationary shaft 148 via first cam member 142 and second cam member 144, respectively, when cam follower 100 is in contact with cam surface 160. Consequently, the shaft of the solenoid is isolated from substantially all of the force applied by springs 95 when cam follower 100 is in contact with cam surface 160.

Figure 9:
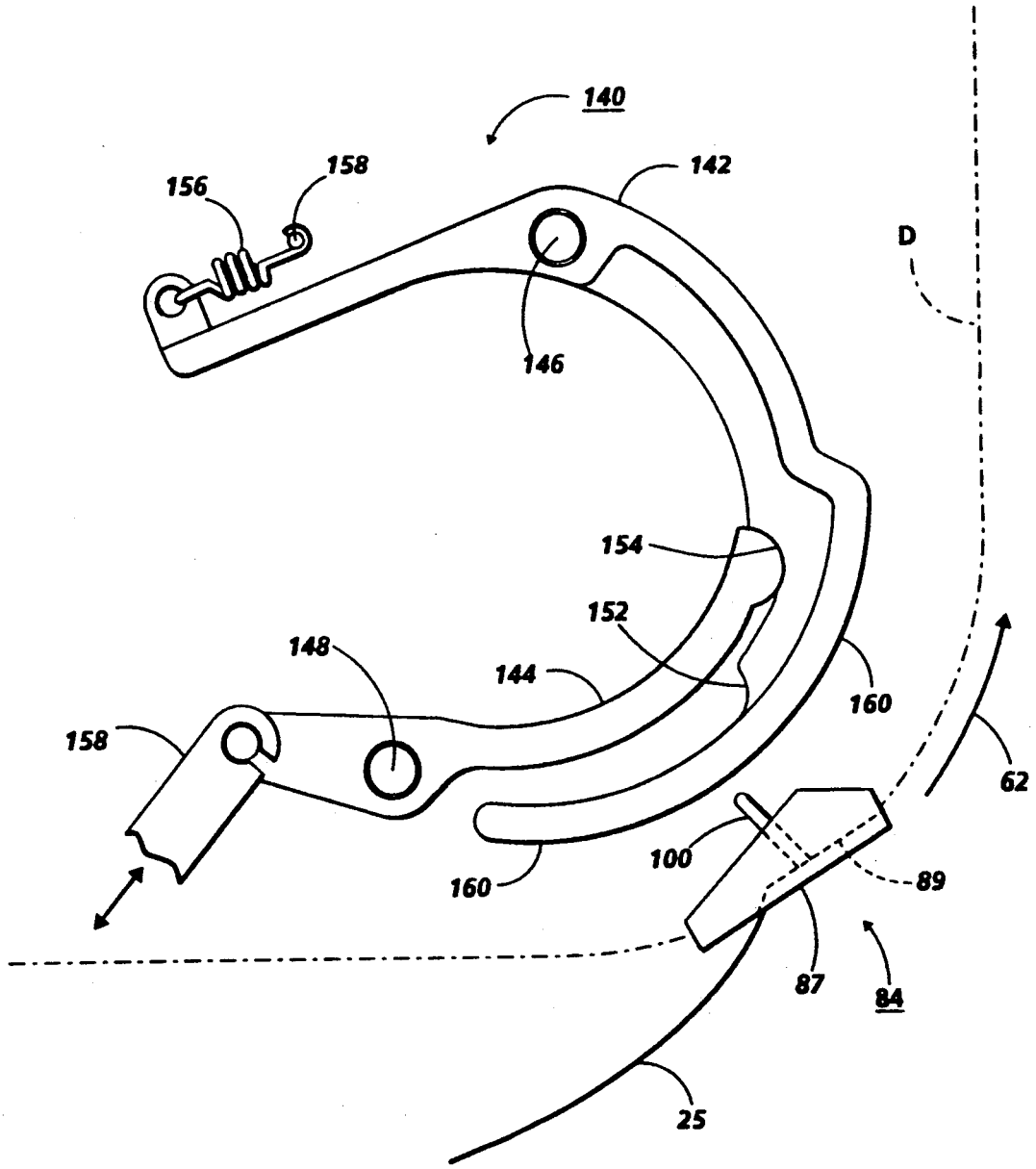
FIG. 9 is a schematic elevational view of the cam mechanism of FIG. 8 wherein the cam mechanism is in another mode of operation.

After the sheet gripper has traveled past cam surface 160 of first cam member 142, the solenoid is actuated to assume another mode of operation. In this mode of operation, the shaft of the solenoid is forced to assume another position thereby causing cam link 158 is assume another position as shown in FIG. 9. As cam link 158 is forced from its position shown in FIG. 8 to its position shown in FIG. 9, first cam member 142 is forced from its position shown in FIG. 8 to its position shown in FIG. 9. When the solenoid is in this mode of operation, cam link 158 is positioned so as to locate first cam member 142, via second cam member 144, to be out of contact with cam follower 100 of sheet gripper 84. Consequently, upper gripping portion 87 is prevented from being displaced relative to lower sheet gripping portion 89 against the bias of springs 95 as sheet gripper 84 passes over first cam member 142.

In recapitulation, the sheet transport apparatus of the present invention includes a cam mechanism which is able to be positioned by a solenoid to cause the sheet gripper to open at a predetermined intervals. The cam mechanism also functions to isolate the force transmitted by the open sheet gripper from the solenoid.

It is, therefore, apparent that there has been provided in accordance with the present invention, a sheet transport system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for releasably gripping a sheet and advancing the sheet through a transfer zone and into registration with information developed on a moving member comprising:

a first gripping member;

a second gripping member adapted to be moved relative to said first gripping member, means for applying a force on said second gripping member to urge said second gripping member towards said first gripping member to grip the sheet;

means for advancing said first gripping member and said second gripping member through the transfer zone;

means for moving said second gripping member relative to said first gripping member to acquire or release the sheet;

means for positioning said moving means in a first mode of operation to allow said moving means to move said second gripping member, and, in a second mode of operation to prevent said moving means from moving said second gripping member; and means for isolating said positioning means from the force applied by said force applying means during the first mode of operation.

2. The apparatus of claim 1, wherein said isolating means includes:

a stationary pivot member; and means defining a cam pivotable about said pivot member with the cam being selectably engageable with said moving means.

3. The apparatus of claim 2, wherein said positioning means is mechanically coupled to said cam.

4. The apparatus of claim 3, wherein said positioning means comprises a solenoid.

5. The apparatus of claim 2, further comprising a cam link operatively disposed between the positioning means and the cam.

6. A printing machine of the type having a toner image developed on a moving member with a sheet being releasably gripped and advanced through a transfer zone and into registration with the toner image comprising:

a first gripping member;

a second gripping member adapted to be moved relative to said first gripping member;

means for applying a force on said second gripping member to urge said second gripping member towards said first gripping member to grip the sheet;

means for advancing said first gripping member and said second gripping member through the transfer zone;

means for moving said second gripping member relative to said first gripping member to acquire or release the sheet;

means for positioning said moving means in a first mode of operation to allow said moving means to move said second gripping member, and, in a second mode of operation to prevent said moving means from moving said second gripping member; and means for isolating said positioning means from the force applied by said force applying means during the first mode of operation.

7. The apparatus of claim 6, wherein said isolating means includes:

a stationary pivot member; and means defining a cam pivotable about said pivot member with the cam being selectably engageable with said moving means.

8. The printing machine of claim 7, wherein said positioning means is mechanically coupled to said cam.

9. The printing machine of claim 8, wherein said positioning means comprises a solenoid.

10. The apparatus of claim 8, further comprising a cam link operatively disposed between the positioning means and the cam.

* * * * *